US006006915A

United States Patent [19]

Moor

[11] Patent Number: 6,006,915

[45] Date of Patent: Dec. 28, 1999

[54] CASE FOR AUDIO DEVICE AND HEADPHONE SET

[75] Inventor: Marc Moor, Oakwood, Ohio

[73] Assignee: The Mead Corporation, Dayton, Ohio

[21] Appl. No.: 09/188,845

[22] Filed: Nov. 9, 1998

[51] Int. Cl.[6] ..... B65D 69/00

[52] U.S. Cl. ..... 206/579; 206/314; 224/929; 190/102

[58] Field of Search ..... 206/223, 320, 206/314, 579, 701, 38; 224/929, 930; 190/102

[56] References Cited

U.S. PATENT DOCUMENTS

| | | | |
|---|---|---|---|
| D. 331,839 | 12/1992 | Patrick | D3/100 |
| 3,158,300 | 11/1964 | Withee | 224/6 |
| 3,521,690 | 7/1970 | Davis | 206/579 |
| 3,734,282 | 5/1973 | Rebold | 206/17.5 |
| 4,134,493 | 1/1979 | Cech | 206/320 |
| 4,141,401 | 2/1979 | Hindemit | 150/52 R |
| 4,151,909 | 5/1979 | Markov | 206/314 |
| 4,249,663 | 2/1981 | Hewlett | 209/705 |
| 4,463,789 | 8/1984 | Leiserson | 150/52 J |
| 4,489,770 | 12/1984 | Reich, II | 150/52 R |
| 4,549,589 | 10/1985 | Nguyen | 150/52 J |
| 4,724,791 | 2/1988 | McSorley | 114/343 |
| 4,770,328 | 9/1988 | Dickhudt et al. | 224/930 |
| 4,817,191 | 3/1989 | Adams . | |
| 4,842,032 | 6/1989 | Mastronardo | 206/308.1 |
| 5,212,734 | 5/1993 | Tsao | 381/188 |
| 5,322,162 | 6/1994 | Melk | 206/310 |
| 5,570,824 | 11/1996 | Lyon et al. | 224/240 |
| 5,706,940 | 1/1998 | Amerello | 206/320 |
| 5,775,558 | 7/1998 | Montalbano | 224/930 |

*Primary Examiner*—David T. Fidei
*Attorney, Agent, or Firm*—Thompson Hine & Flory LLP

[57] ABSTRACT

A substantially pear-shaped case (30) for an audio device (20), such as a compact disc player, and headphone set (10), the case (30) formed of a base (32) with side walls (34) extending therefrom to form a compartment tapering inwardly terminating in a narrowed portion distal the base (32). In combination, the audio device (20) is disposed in substantially upright condition in the compartment of the case (30) while the headphones (10) lie in an inverted substantially upright position with the ear speakers (12) lying in an upper narrowed portion (37) of the case and the curved connecting member (14) arranged in a U-shaped configuration lying in cooperative nesting position with the audio device (20) adjacent the base (32) of the case (30).

14 Claims, 3 Drawing Sheets

CASE FOR AUDIO DEVICE AND HEADPHONE SET

The invention relates to cases for articles, and, more particularly, relates to a case for receiving and transporting an audio device, such as a compact disc player, and headphones.

Carrying cases are useful for storing and transporting personal articles. Cases specifically made for receiving particular objects are especially useful for storing and transporting those articles. Examples of general and special-purpose cases for articles are disclosed in U.S. Pat. No. 4,489,770 to Reich, II, U.S. Pat. No. 4,724,791 to McSorley, U.S. Pat. No. 4,463,789 to Leiserson, U.S. Pat. No. 4,549,589 Nguyen, U.S. Pat. No. 4,249,663 to Hewett, U.S. Pat. No. 4,141,401 to Hindemit, U.S. Pat. No. 3,734,282 to Rebold, U.S. Pat. No. 3,158,300 to Withee, and U.S. Pat. No. 1,718,276 to Child.

With the increased popularity of personal audio devices such as compact disc players and the headphones which accompany them, it can be appreciated that it would be useful to have a case particularly suitable for storing and transporting an audio device and accompanying headphones.

SUMMARY OF THE INVENTION

The present invention provides a substantially pear-shaped case for an audio device, such as a compact disc player, and a set of headphones. In combination, the audio device sits substantially upright in the compartment of the case while the headphones lie in an inverted upright position with the ear speakers lying in an upper tapered portion of the case and with the connecting member of the speakers lying in a cooperative nesting position with the audio device.

Other advantages and objects of the present invention will be apparent from the following description, the accompanying drawings, and the appended claims.

DETAILED DESCRIPTION OF THE PREFERRED EMBODIMENT

Figure 1:
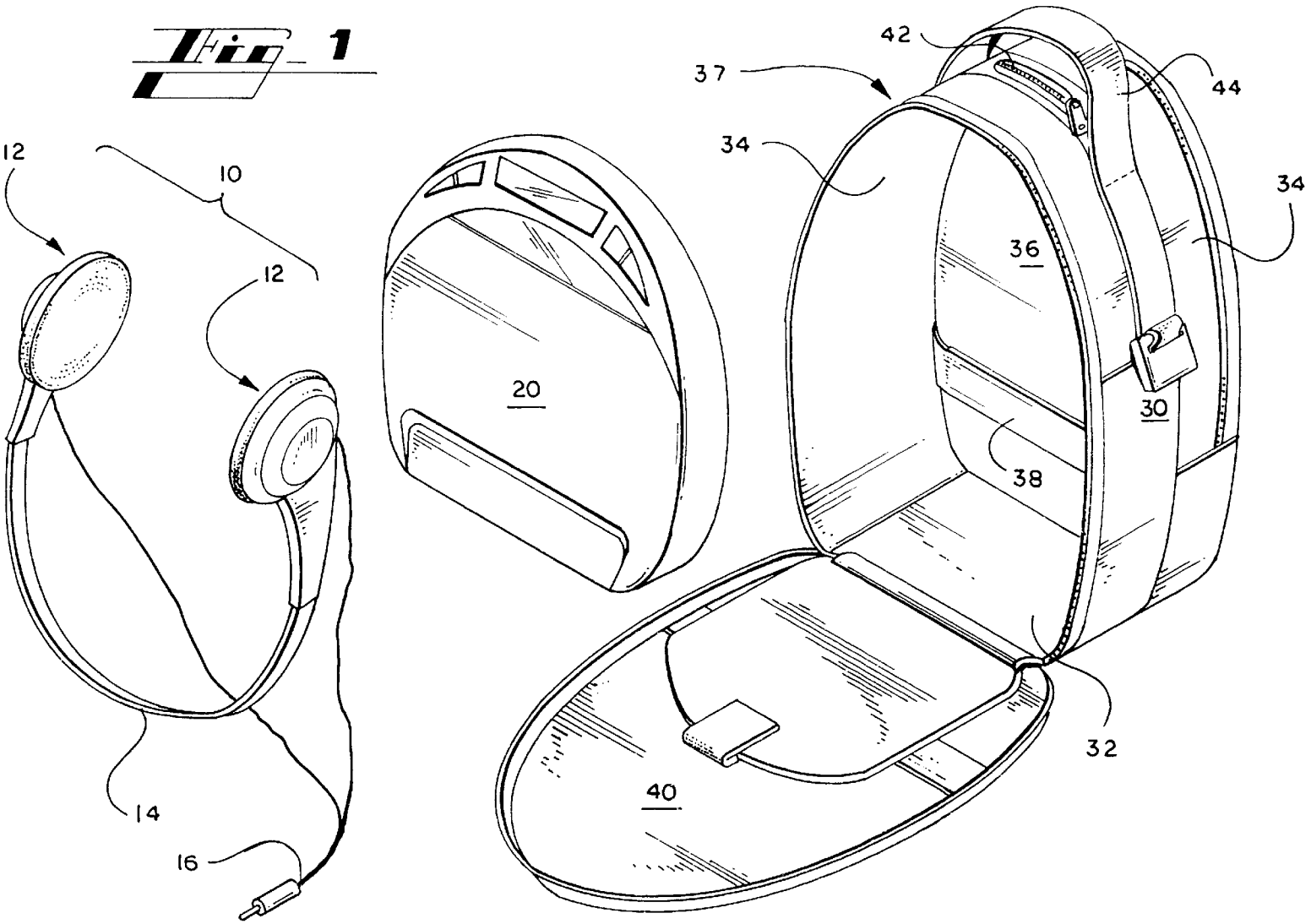
FIG. 1 is an isometric illustration of a case for an audio device and set of headphones in juxtaposition therewith in accordance with a preferred embodiment of the invention.

Throughout the drawings the same reference numerals are used to denote the same or like features of the invention. The case of the subject invention is formed from an arrangement of what are essentially panels or webs. These panels/webs are described in more distinct terms below.

Figure 2:
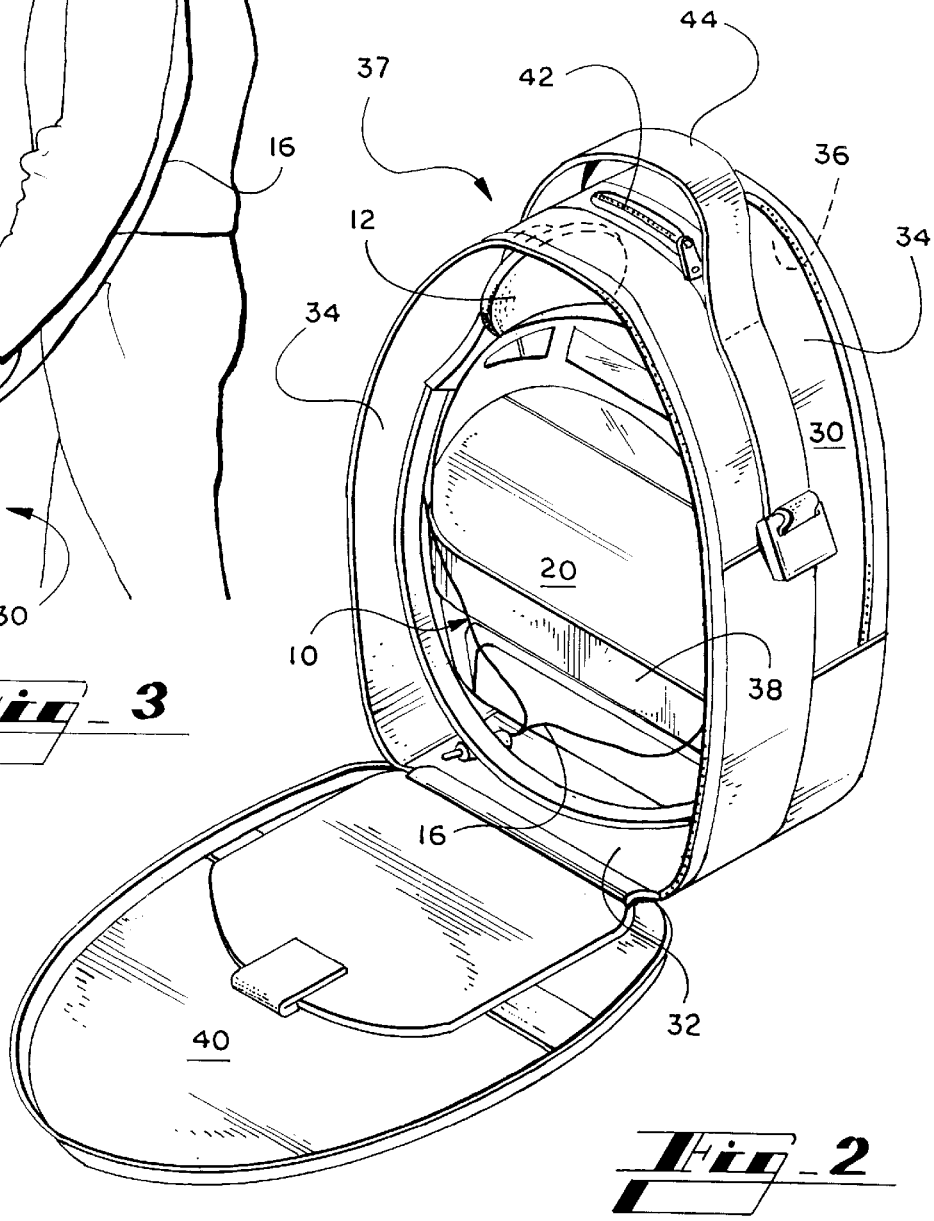
FIG. 2 is an isometric illustration of the case, audio device and headphones of FIG. 1 in a combination configuration with one another.

Referring first to FIGS. 1 and 2 simultaneously, therein are illustrated a case 30 for an audio device 20 (such as a compact disc player) and set of headphones 10. The case 30, audio device 20 and headphone set 10 are illustrated in juxtaposition with one another and in combination with one another, respectively, in accordance with a preferred embodiment of the invention. The case 30 is substantially pear-shaped in that the top portion is narrowly-tapered in comparison with the base 30. The side walls 34 of the case 30 extend upwardly from the base 32 to form a compartment. The walls 34 taper inwardly to form the narrowed top portion 37 of the case 30 and compartment.

A transverse abutment structure 36 extends across the side walls 34 and serves as a backstop for the compartment formed by the side walls 34 and base 32. The transverse abutment structure 36 may take the form of an end or rear wall (or panel) or may take the form of a central partition (or panel) if the case has compartments formed on either side of the transverse abutment structure 36. In the preferred embodiment illustrated a retaining member 38 in the form of a strap extends across the abutment structure 36. The audio device 20 is inserted between the retaining member 38 and the abutment structure 36. As shown more clearly in FIG. 2, the retaining member 38 receives the audio device 20 and releasably secures it to the transverse abutment structure 36.

Figure 3:
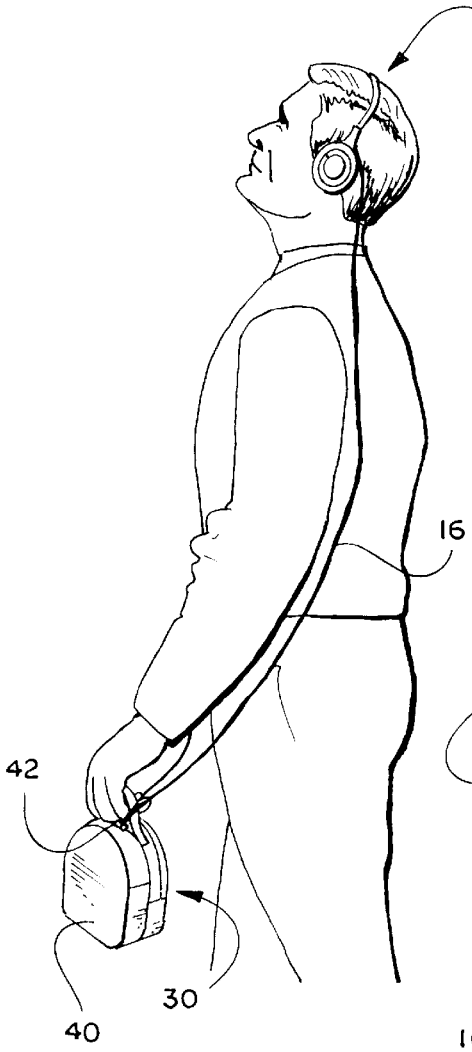
FIG. 3 is an illustration of the invention of FIG. 1 with the headphones being utilized outside of the case through means of the cord-strand aperture feature of the case.

An aperture 42 for passage of a headphone cord 16 is formed at a point in the side walls 34. The connecting cord for a set of headphones typically consists of a strand or strands of insulated wire. The aperture 42 permits a headphone cord 16 to extend through the case 30 such that a pair of headphones 10 may be plugged into an audio device 20 while the audio device 20 is secured in the case 30. In the preferred embodiment illustrated the aperture 42 lies at the top of the case 30. Referring briefly to FIG. 3, it is noted that placement of the aperture 42 at the top of the case 30 makes it particularly convenient to utilize the headphones 10 to play the audio device 20 while the device 20 is stored in the case 30 and the case 30 is transported by means of a handle 44.

Referring now to FIGS. 1, 2 and 3 simultaneously, a removable cover, or panel, 40 is positionable over the opening to the compartment formed by the base 32 and side walls 34. The cover 40 may be removably affixed over the opening by known securing mechanisms such as zipper or clasp.

Referring now particularly to FIGS. 1 and 2, the disposition of the case 30, audio device 20 and headphones 10 in combination with one another will be further described. The audio device 20 (such as a compact disc player) is placed in substantially upright condition in the case 30. For added securement the audio device 20 is secured within the case 30 by the retaining member 38. The headphone 10 unit is placed within the case 30 in an inverted, substantially upright condition in nesting relationship with the audio device 20. In this position the curved connecting member 14 which extends between the ear speakers 12 is positioned at the base end of the case in close nested arrangement with the audio device 20. This disposition causes the speakers 12 to be positioned within the top, narrowed portion 37 of the compartment of the case 30.

The connecting member 14 for a headphone set 10 is typically a length of narrow, thin, semi-rigid, flexible material such as metal or plastic, or a combination of such metal and plastic elements. The connecting member 14 is typically fixed in an arced configuration. The arced configuration of the thin connecting member 14 permits the member 14 to be placed in close-contacting nested relationship with the audio device as shown in FIG. 2. The curvature of the typical connecting member 14 causes the speakers 12 to lie at the extreme opposite end of the U-shape assumed by the connecting member 14 when the connecting member is flexed inwardly and placed in the case 14. The length of the connecting member 14 permits the speakers 12 to be positioned above the audio device 20. Because the connecting member 14 is typically thin and narrow, as illustrated, it may be placed substantially flush against the face of the audio device 20 without projecting significantly beyond the face of the audio device 20. Because the connecting member 14 is flexible and generally lies within an imaginary plane, and because the speakers 12 are typically mounted so that they are disposed at the ends of the connecting member 14, the speakers 12 do not extend significantly beyond (if at all) the depth of the audio device 30. The flexibility of the connecting member allows the speakers 12 to be rotated slightly to minimize the space occupied by the speakers 12 when the headphone set 10 is placed in the case 30. Even when each of the speakers 12 is substantially transversely oriented with respect to the imaginary plane in which the connecting member lies, the speakers do not project significantly outwardly beyond the face of the audio device. Further, in the arrangement of the preferred embodiment the rearward projection of the speakers generally lies within the depth of the audio device 20 or does not extend significantly beyond the device's depth.

Figure 4:
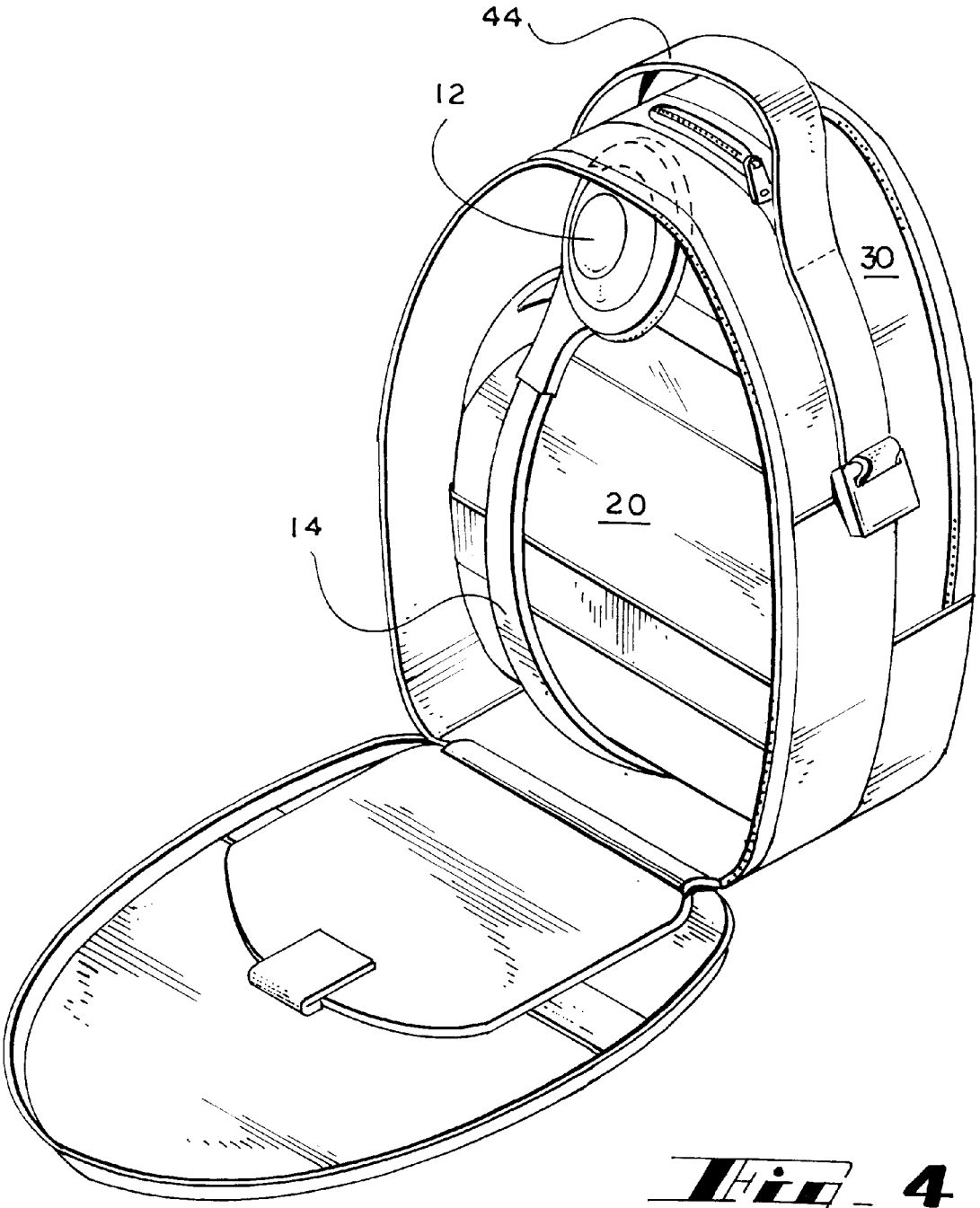
FIG. 4 is an illustration of an alternate embodiment of the combination configuration of the case, audio device and headphones of FIG. 1.

When forming the combination, the audio device 20 is placed within the case 30 substantially upright either within or without the retaining strap 38. The headphone set 10 is arranged in the U-shaped configuration and placed in close relationship with the audio device. If the audio device is sufficiently smaller than the area circumscribed by the connecting member 14 the headphone set 10 and audio device may be positioned such that the U-shaped connecting member circumscribes the audio device. The order in which the audio device 20 and headphone set 10 are placed in the case 30 with respect to one another may vary from that described immediately above. For example, the headphone set may be placed within the case before the audio device is inserted. Or, the headphone set and audio device may be juxtaposed in nesting condition with one another as previously described above but outside of the case and then inserted together into the case. Referring momentarily to FIG. 4, an alternative arrangement is illustrated wherein the headphone set 10 and audio device 20 are aligned in a substantially transverse relationship with respect to one another. In any of the configurations described above the speakers and connecting member can be slightly torqued with respect to one another as may be necessary to place the audio device and headphone set within the case.

Suitable dimensions for a preferred embodiment of the case 30 are a width (across the base 32 from side wall to side wall 34) of about 6 inches, a height (from base 32 to apex) of about 7¾ inches, and a depth of about 5 inches. The case may be formed of any panel type material capable of being configured into the elements described and illustrated herein. One such suitable material in general is nylon. A suitable specific type of nylon is known in the textile industry as 420-D nylon. A reinforcing, protective, padding material such as a layer of 3/16 inch pearlized foam is suitable for insertion between multiple plies of the wall material. The handle 44 may be formed of many different types of materials capable of being configured into a handle structure. A suitable handle material is light-weight nylon webbing. In the preferred embodiment illustrated the handle 44 is reinforced at its center by a material such as 1/16 inch expanded PVC.

The case 30 provides a convenient means for storing and transporting associated audio devices 20 and headphone sets 10. The combination of the case 30, audio device 20 and headphone set provides a compact, convenient package. And, the method by which the headphone set 10 and audio device 20 are placed within the case 30 provides a convenient method for forming the package.

Modifications may be made in the foregoing without departing from the scope and spirit of the claimed invention. For example, the audio device 20 may have different configurations. However, it is to be noted that the case 30 and combination are particularly accommodating when the device 20 is a compact disc player or other mechanism which has a rounded or otherwise tapered end portion (as illustrated) which is positioned near or adjacent the tapered end portion of the case 30. The tapered end of the audio device 30 also helps further facilitate nesting of the headphone set 10 therewith.

What is claimed is:

1. A case for an audio device and headphone set comprising:

a base;

a pair of side walls extending upwardly from said base terminating in a top end distal said base, said top end being narrower than said base and having an aperture formed therethrough for the passage of a cord strand, said base and said side walls defining a chamber for closely receiving the audio device and headphone set; and a cover removably affixable over said chamber.

2. The invention of claim 1, further comprising an abutment structure extending between said side walls.

3. The invention of claim 1, said side walls having an aperture formed therethrough for passage of a strand.

4. In combination, an audio device, a set of headphones, and a case for storing and transporting the audio device and set of headphones comprising:

a substantially pear-shaped case including a base;

side walls extending from said base defining a compartment with an upper tapered region distal said base; and a cover removably affixable over said compartment;

an audio device disposed in substantially upright condition within said compartment; and a set of headphones having speakers disposed at opposing ends of a connecting member lying in inverted substantially upright condition within said compartment with the connecting member arranged in a U-shaped configuration in nesting juxtaposition with said audio device with the speakers disposed in said upper tapered region of said substantially pear-shaped case.

5. The invention of claim 4, wherein the audio device is disposed between an abutment structure and a retaining member which extend between said side walls.

6. The invention of claim 4, said substantially pear-shaped case further including an aperture for passage therethrough of a cord strand.

7. A method for forming a package comprising:

placing in juxtaposition with respect to one another within a compartment of a substantially pear-shaped case including a base, sidewalls extending from said base to form said compartment said side walls tapering inwardly to form a narrowed portion of said compartment distal said base, and a cover removably affixable over said compartment an audio device in substantially upright condition in said compartment;

a headphone set which includes a pair of headphone speakers disposed at opposing ends of a connecting member in said compartment in inverted substantially upright condition with said connecting member in a U-shaped configuration disposed adjacent said base such that said speakers are disposed within said narrowed portion of said compartment.

8. The invention of claim 7, further comprising the step of securing said audio device within said compartment.

9. The invention of claim 8, wherein the step of securing said audio device within said compartment comprises placing the audio device between an abutment structure and a retaining member which extend between said side walls of said substantially pear-shaped case.

10. In combination, an audio device, a set of headphones, and a case for storing and transporting the audio device and set of headphones comprising:

a substantially pear-shaped case including a base and side walls extending from said base defining a compartment with an upper tapered region distal said base including an aperture for passage therethrough of a cord strand;

an audio device disposed in substantially upright condition within said compartment; and a set of headphones lying outside of the case with a cord extending through said aperture into said case.

11. The invention of claim 10, wherein the audio device is disposed between an abutment structure and a retaining member which extend between said side walls.

12. The case of claim 1 wherein said side walls are generally curved and taper inwardly toward said top end.

13. The case of claim 1 further comprising a strap that can be passed around said audio device to retain said audio device in said case.

14. The case of claim 13 wherein said strap extends between said side walls.

* * * * *